US006661980B2

(12) United States Patent
Matsumoto et al.

(10) Patent No.: US 6,661,980 B2
(45) Date of Patent: Dec. 9, 2003

(54) IMAGE FORMING APPARATUS AND IMAGE FORMING SYSTEM

(75) Inventors: Hideki Matsumoto, Shizuoka (JP); Takeo Shoji, Shizuoka (JP); Norihito Naito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/091,506

(22) Filed: Mar. 7, 2002

(65) Prior Publication Data

US 2002/0127024 A1 Sep. 12, 2002

(30) Foreign Application Priority Data

Mar. 9, 2001 (JP) ..... 2001/067598

(51) Int. Cl.[7] ..... G03G 15/00
(52) U.S. Cl. ..... 399/27; 399/43
(58) Field of Search ..... 399/27, 24, 43, 399/8, 9, 38, 61

(56) References Cited

U.S. PATENT DOCUMENTS 4,592,646 A * 6/1986 Suzuki et al. ..... 399/43
2001/0038758 A1 * 11/2001 Oguma et al. ..... 399/27
2002/0057918 A1 * 5/2002 Kojima et al. ..... 399/27

FOREIGN PATENT DOCUMENTS

JP 61-232475 * 10/1986

* cited by examiner

*Primary Examiner*—Sophia S. Chen
(74) *Attorney, Agent, or Firm*—Fitzpatrick, Cella, Harper & Scinto

(57) ABSTRACT

A cartridge includes a developing apparatus equipped with a developer containing portion containing a developer, a residual developer amount detecting device for detecting a residual developer amount in the developer containing portion, and a storage device capable of storing the latest residual developer amount information. An image forming apparatus includes a continuous rest time counter configured to count a continuous rest time of the image forming apparatus, and a controller which is configured to prohibit updating of the residual developer amount information to the storage device for a predetermined period after the end of the continuous rest time of the image forming apparatus when the continuous rest time counter indicates a time not shorter than a predetermined time. This structure provides an image forming apparatus and an image forming system in which no deterioration in detection accuracy occurs even if an unstable toner state occurs due to a long printing rest time.

20 Claims, 9 Drawing Sheets

IMAGE FORMING APPARATUS AND IMAGE FORMING SYSTEM

BACKGROUND OF THE INVENTION

1. Field of the Invention

The present invention generally relates to an electrophotographic image forming apparatus, in particular, to an image forming apparatus and an image forming system in which a cartridge, that is, a process cartridge or a developing apparatus in the form of a cartridge (also referred to as a "developing cartridge") can be attached to the main body of the image forming apparatus and which are equipped with a residual developer amount detecting means for detecting a residual developer amount by using a storage means mounted in the cartridge.

Examples of the image forming apparatus include an electrophotographic copying machine, an electrophotographic printer (for example, an LED printer and a laser beam printer), an electrophotographic facsimile apparatus, and an electrophotographic word processor.

The cartridge detachably attachable to the image forming apparatus main body has at least one of an electrophotographic photosensitive body, a charging means for charging the electrophotographic photosensitive body, a developing means for supplying developer to the electrophotographic photosensitive body, and a cleaning means for cleaning the electrophotographic photosensitive body.

In particular, the process cartridge is obtained by forming at least one of a charging means, a developing means, and a cleaning means, and an electrophotographic photosensitive body into an integral cartridge, which is detachably attachable to the image forming apparatus main body. Alternatively, it is obtained by forming at least a developing means and an electrophotographic photosensitive body into an integral cartridge, which is detachably attachable to the image forming apparatus main body.

2. Description of Related Art

In an image forming apparatus, such as a copying machine or a laser beam printer, a beam corresponding to image information is applied to an electrophotographic photosensitive body (hereinafter referred to as the "photosensitive body") to form an electrostatic latent image, and a developer (toner) serving as the recording material is supplied to this electrostatic latent image by a developing means to thereby visualize the image. Further, the image is transferred from the photosensitive body to a recording paper sheet serving as the recording medium to thereby form an image on the recording paper sheet. The developing means is connected to a toner container serving as the developer containing part containing toner, and the toner is consumed as images are formed. In many cases, the developer containing part, the developing means, the photosensitive body, the charging means, etc. are formed into an integral process cartridge. When the toner has been used up, the user replaces the process cartridge with a new one, whereby it is possible to perform image formation anew.

Nowadays, in more and more cases the process cartridge or the image forming apparatus main body is equipped with a "residual toner amount level detecting means" (sequential residual developer amount detecting means) making it possible to know at any time the amount of toner for image formation remaining in the process cartridge.

In an example of the sequential residual developer amount detecting means, a metal plate is used. In this system, there is provided at least one flat sheet metal (metal plate) opposed to a developing roller serving as the developing means, and the developing roller and the metal plate or the metal plates or both of them are used as capacitor electrodes, utilizing the phenomenon in which the electrostatic capacitance between the electrodes changes with the amount of toner, which is an insulator. That is, if the inter-capacitor space formed by the metal plates and the developing roller is filled with toner, the electrostatic capacitance is large. As the toner is consumed, the amount of air in the space increases, thereby reducing the electrostatic capacitance.

Further, there is prepared a correcting table in which a relationship is previously established between the electrostatic capacitance between the metal plate and the developing roller and the toner amount, so that the residual toner amount level in the toner container can be calculated through measurement of the inter-capacitor capacitance.

In another system, a storage means (memory) which allows reading and writing is provided for each process cartridge (hereinafter referred to as the "cartridge"), and correction information, such as information on the inherent production tolerance of the cartridges, information on the present residual toner amount, etc. are stored, whereby the computation of the residual toner amount level using the above-mentioned "residual toner level detecting means" is performed more accurately.

However, when detection is performed by using such residual developer amount detecting means or storage means, it can occur that a detection value corresponding to an unstable toner state (for example, an unpredictable toner height), which exists in a range that can be detected by the residual developer amount detecting means, is stored. In that case, it is highly possible that the residual amount detection accuracy deteriorates.

The toner state may become unstable, for example, when the interval between the completion of printing operation for one job and the start of the next job (printing rest period) is very long.

In such cases, the state of the toner in the cartridge is unstable, and when the value at this time is used as the correction value, the accuracy of the residual toner amount detection value thereafter is always low, and it is quite possible that, even when it is not used as the correction value, a detection value of low accuracy will be temporarily obtained.

SUMMARY OF THE INVENTION

The present invention has been made in view of the above, and an object of the present invention to provide an image forming apparatus and an image forming system in which if the toner is put in an unstable state as a result of a long printing rest period, the detection accuracy does not deteriorate.

In order to attain the above-mentioned object, according to the present invention, there is provided an image forming apparatus to which a cartridge is detachably attachable, the cartridge having: a developing apparatus equipped with a developer containing portion containing a developer, a residual developer amount detecting means for detecting a residual developer amount in the developer containing portion, and a storage means capable of storing the latest residual developer amount information, wherein the image forming apparatus includes:

a continuous rest time counter for counting a continuous rest time of a driving system of the image forming apparatus; and a control means for prohibiting updating of the residual developer amount information to the storage means for a predetermined interval when the continuous rest time counter indicates a time not shorter than (equal to or more than) a predetermined time.

Further, according to the present invention, there is provided an image forming system for forming an image on a recording medium by using a cartridge detachably attachable to an image forming apparatus, the image forming system comprising:

(a) a cartridge having: a developing apparatus equipped with a developer containing portion containing a developer; a residual developer amount detecting means for detecting a residual developer amount in the developer containing portion; and a storage means capable of storing the latest residual developer amount information; and (b) an image forming apparatus main body equipped with a continuous rest time counter for counting a continuous rest time of a driving system, and a control means which prohibits updating of the residual developer amount information to the storage means for a predetermined interval when the continuous rest time counter indicates a time not shorter than a predetermined time.

Preferably, the predetermined interval is a predetermined driving time of the driving system of the image forming apparatus. Alternatively, the predetermined interval corresponds to a predetermined number of printed sheets.

Preferably, the residual developer amount detecting means outputs a signal obtained by measuring an electrostatic capacitance between at least two electrodes.

Preferably, an image forming system according to the present invention further comprises an indication means, in which a signal for indicating information on a detected residual developer amount is transmitted to the indication means for display.

Preferably, an image forming system according to the present invention is further capable of communicating with an apparatus having an indication means, in which a signal for indicating information on a detected residual developer amount is transmitted to the apparatus having the indication means for display.

Preferably, the cartridge further includes at least one of an electrophotographic photosensitive body, a charging means for charging the electrophotographic photosensitive body, a developing means for supplying developer to the electrophotographic photosensitive body, and a cleaning means for cleaning the electrophotographic photosensitive body.

In accordance with the present invention, the detection value immediately after a long-term rest, when the developer is in an unstable state, is not stored, so that if the developer is put in an unstable state as a result of a long printing rest period, there is no deterioration in detection accuracy, and it is always possible to perform detection in a stable manner without deteriorating the residual developer amount detection accuracy, thus making it possible to achieve a stable image quality.

These and other objects and advantages of the invention may be readily ascertained by referring to the following description and accompanying drawings.

DESCRIPTION OF THE PREFERRED EMBODIMENTS

An image forming apparatus and an image forming system according to the present invention will now be described in more detail with reference to the accompanying drawings.

First Embodiment

An image forming apparatus according to an embodiment of the present invention consists of a laser beam printer which receives image information from a host computer and performs image output. It is an electrophotographic image forming apparatus in which the consumable items, such as an electrophotographic photosensitive body, developing means, and toner, are provided in the form of a process cartridge, which is detachable and replaceable with respect to the apparatus main body.

The construction and operation of an electrophotographic image forming apparatus to which a process cartridge according to this embodiment is attached will be described with reference to FIGS. 1 through 3.

Figure 1:
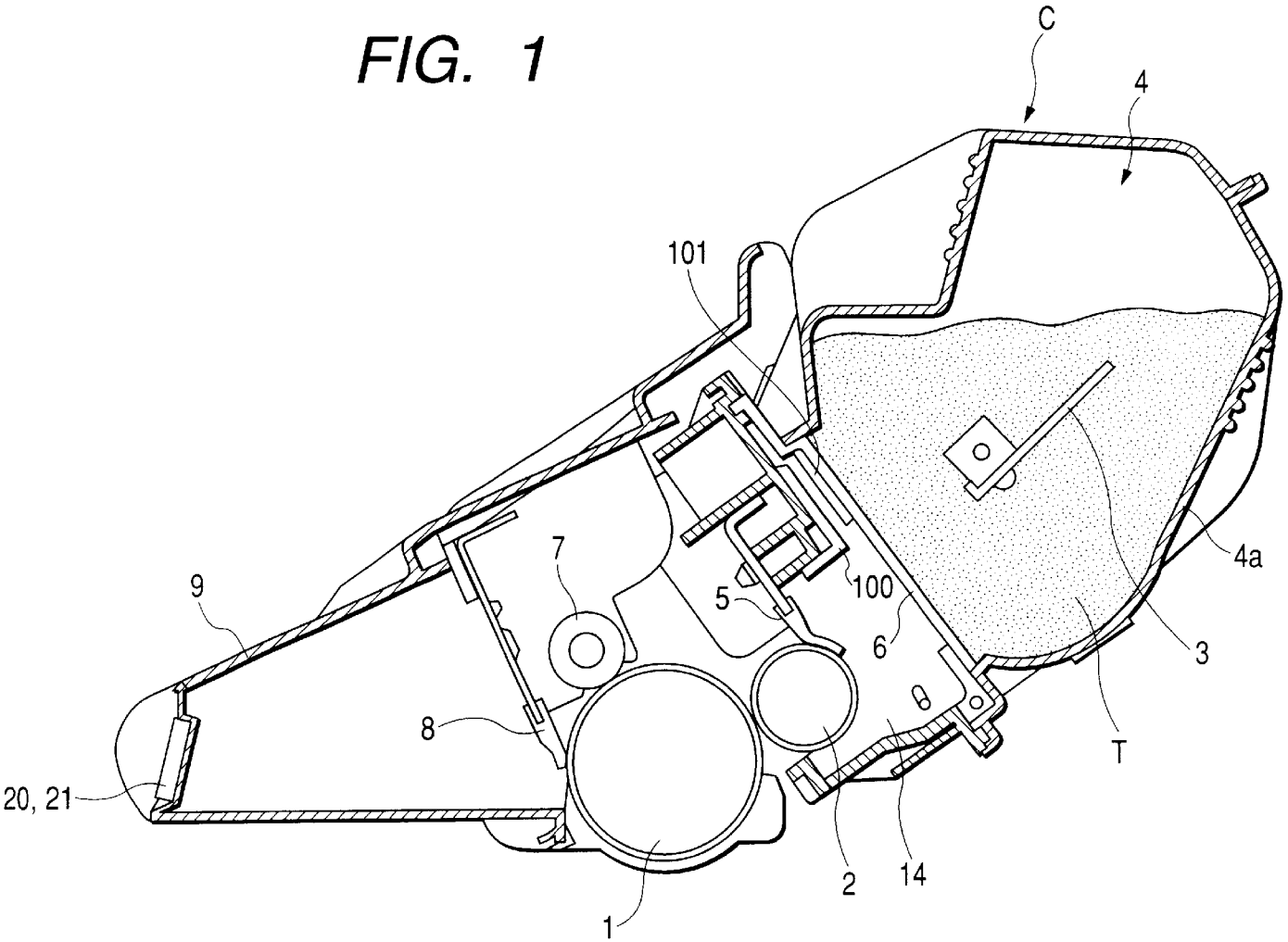
FIG. 1 is a diagram showing the construction of a process cartridge according to an embodiment of the present invention.
Figure 3:
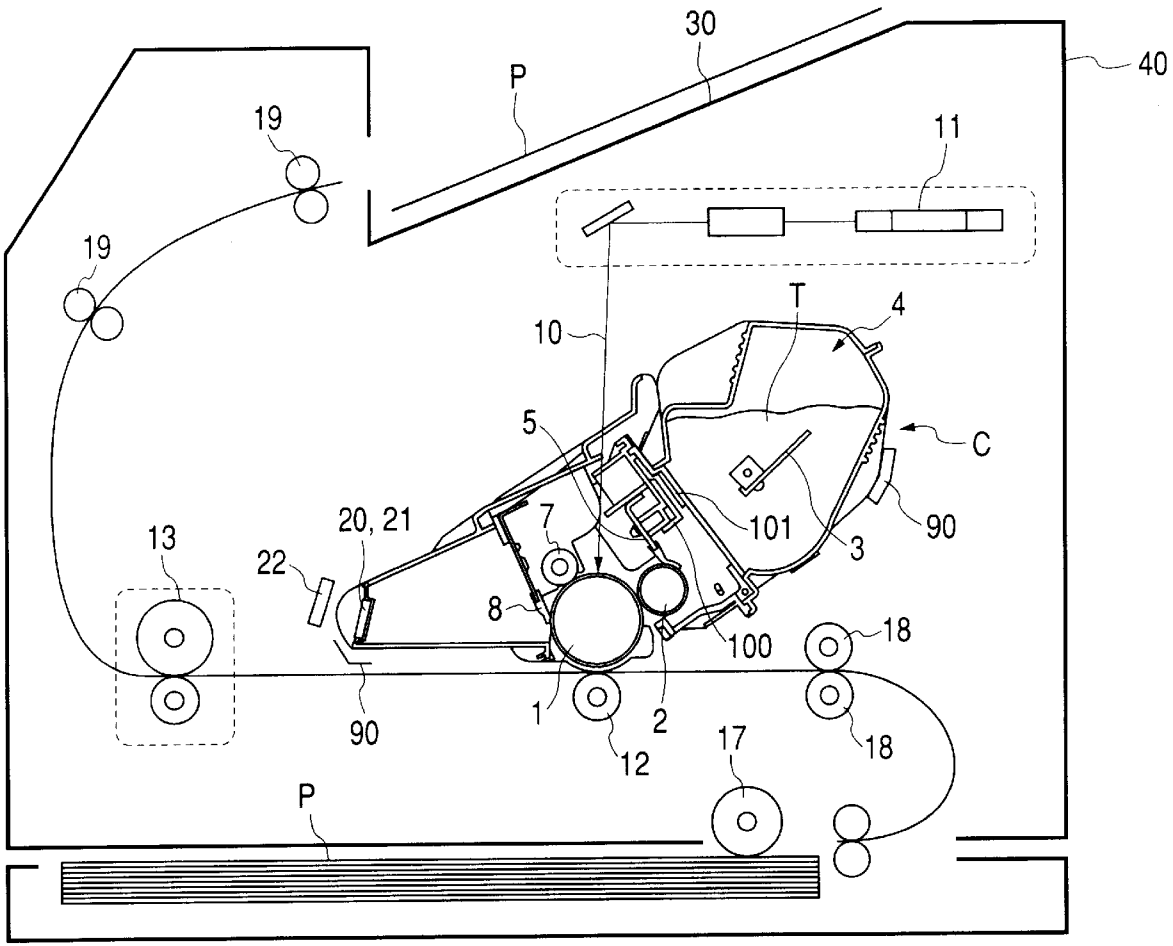
FIG. 3 is a diagram showing the construction of an embodiment of an electrophotographic image forming apparatus to which a process cartridge according to the present invention is attached.

As shown in FIG. 1, the process cartridge (hereinafter referred to as the "cartridge") C is formed as an integral unit comprising a photosensitive drum 1 which is an electrophotographic photosensitive body serving as the image bearing body, a charging roller 7 serving as the charging means for uniformly charging the photosensitive drum 1, a developing apparatus 4, a cleaning blade 8 which is a cleaning means for cleaning the surface of the photosensitive drum 1, and a waste toner container 9 for accommodating residual toner removed from the photosensitive drum 1 by the cleaning blade 8, and, as shown in FIG. 3, is detachably attached to the image forming apparatus main body (hereinafter simply referred to as the "apparatus main body") 40 through the intermediation of an attachment means 90.

The developing apparatus 4 is equipped with a toner container 4*a* which is a developer accommodating part for accommodating developer (toner) T, a developing container 14 connected to the toner container 4*a*, a developing roller 2 opposed to the photosensitive drum 1 and serving as the developing means, a developing blade 5 abutting the developing roller 2 and serving as a developer regulating member for regulating toner layer thickness, and an agitating member 3 for agitating the toner T in the toner container 4*a* and conveying it to the developing roller 2.

Further, before use of the cartridge, a toner sealing member 6 is attached between the toner container 4 and the developing container 14. This toner sealing member 6 is provided so that no toner may leak if the cartridge undergoes great impact or the like during its transportation etc., and is opened by the user immediately before attaching the cartridge C to the apparatus main body 40.

As shown in FIG. 3, in the laser beam printer, there is provided above the process cartridge C a laser scanner 11 for applying a laser beam 10 in correspondence with image information, and there is provided below the same a transferring roller 12 which is a transferring means opposed to the photosensitive drum 1.

In the above-described construction, the photosensitive drum 1 is uniformly charged by the charging roller 7, and scanning/exposure is effected on the surface thereof with the laser beam 10 emitted from the laser scanner 11 to form a desired electrostatic latent image of the image information. Toner T is applied to the electrostatic latent image by the action of the developing roller 2, etc. to visualize the image as a toner image. In this embodiment, the developer used is an insulating magnetic one-component toner.

In a sheet feeding cassette, recording sheets P serving as the recording media are stacked together. The recording sheets P are picked up one by one by a pick-up roller 17 and each of them is conveyed to a registration roller pair 18, by means of which they are conveyed to a transferring part in synchronism with the forming of the toner image on the photosensitive drum 1. Then, by the action of the transferring roller 12, the toner image on the photosensitive drum 1 is transferred to the recording sheet P. The recording sheet P to which the toner image has been transferred is conveyed to a fixing apparatus 13, where the toner image is melted and fixed through heating and pressurization. Thereafter, the sheet is discharged onto a tray 30 by a sheet discharging roller 19.

<Residual Developer Amount Detecting Means>

Figure 2:
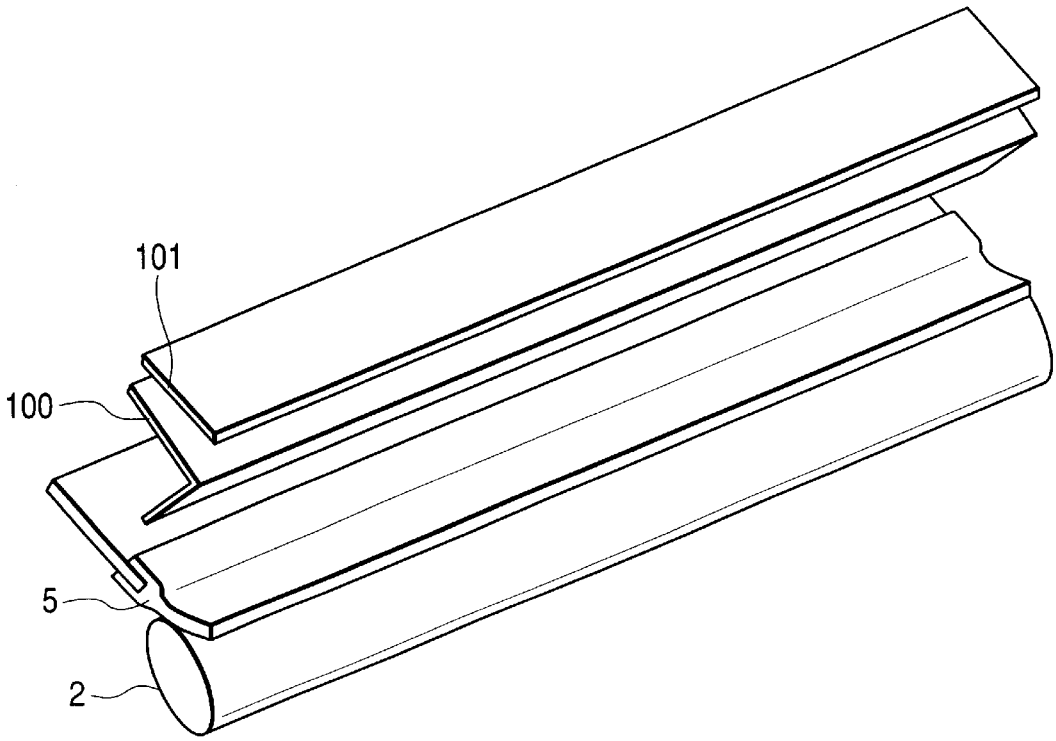
FIG. 2 is a perspective view showing a developing apparatus constituting a process cartridge according to the present invention.

As shown in FIGS. 1 and 2, in this embodiment, the developing roller 2, a first metal plate 100 and a second metal plate 101 are used as the residual developer amount detecting means. The first metal plate 100 is provided opposite to the developing roller 2 so as to extend over the entire longitudinal area of the developing apparatus 4, and the second metal plate 101 has substantially the same longitudinal size as the first metal plate 100, and is provided opposite to the metal plate 100.

There are no particular limitations regarding the material of the first metal plate 100 and the second metal plate 101 as long as they basically allow the flow of electric current as plate electrodes. In this embodiment, stainless steel (SUS), which is resistant to rusting, is used.

<Residual Developer Amount Detecting Circuit>

Figure 4:
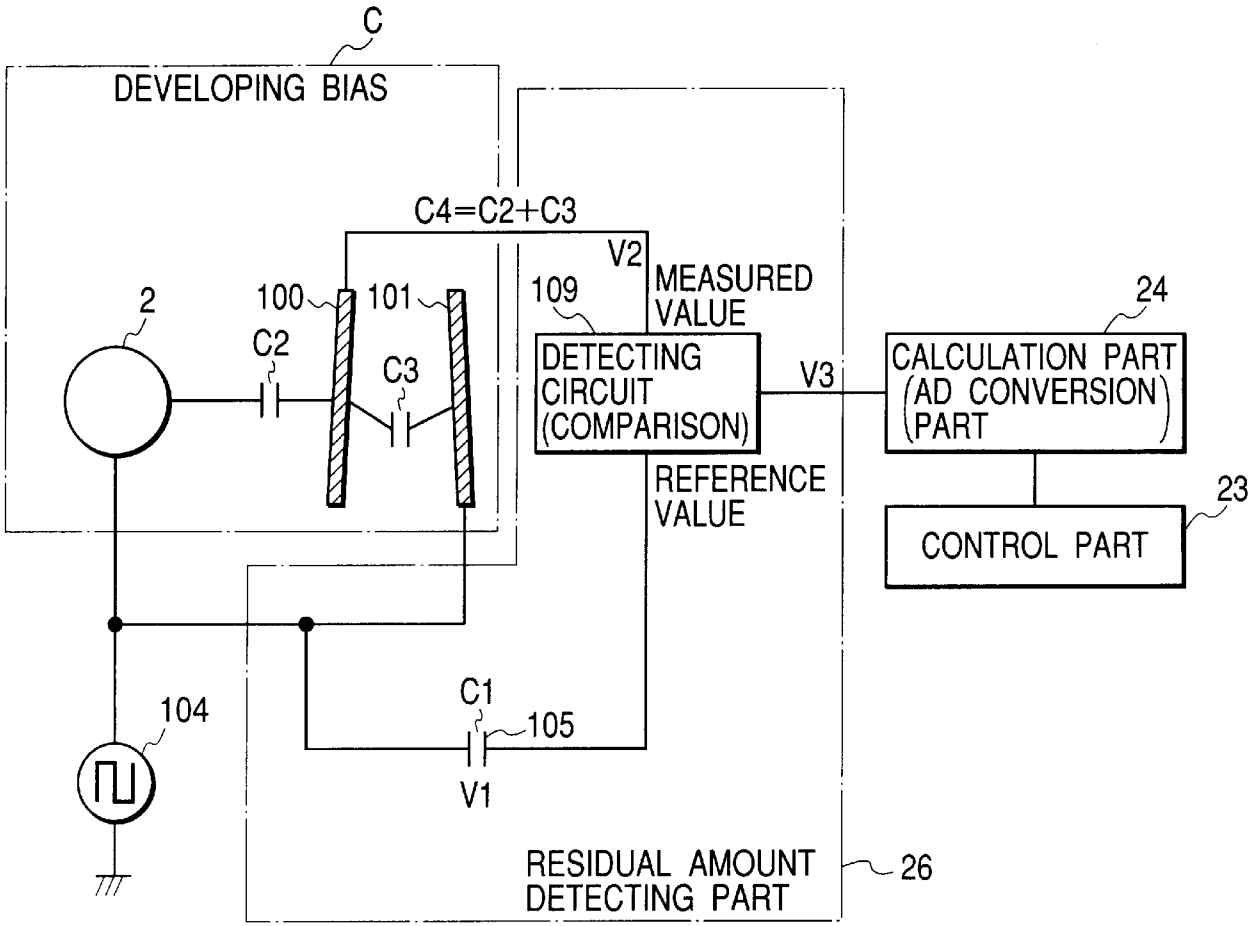
FIG. 4 is a circuit diagram showing a residual developer amount detecting device according to an embodiment of the present invention.

FIG. 4 shows the circuit configuration of a residual amount detecting part 26 when the cartridge C is normally attached to the apparatus main body 40.

The apparatus main body 40 and the cartridge C are provided with electric contacts (not shown). When the cartridge C is mounted in the apparatus main body 40, the first metal plate 100 and the second metal plate 101 of the cartridge C are electrically connected to the residual amount detecting part 26 in the apparatus main body 40 through the electric contacts.

In FIG. 4, when a predetermined AC bias is output from a developing bias circuit 104 as a developing bias applying means, the application bias is applied to a reference capacitor 105 having a fixed electrostatic capacitance, the developing roller 2 in the developing apparatus 4, and the second metal plate 101.

Figure 5:
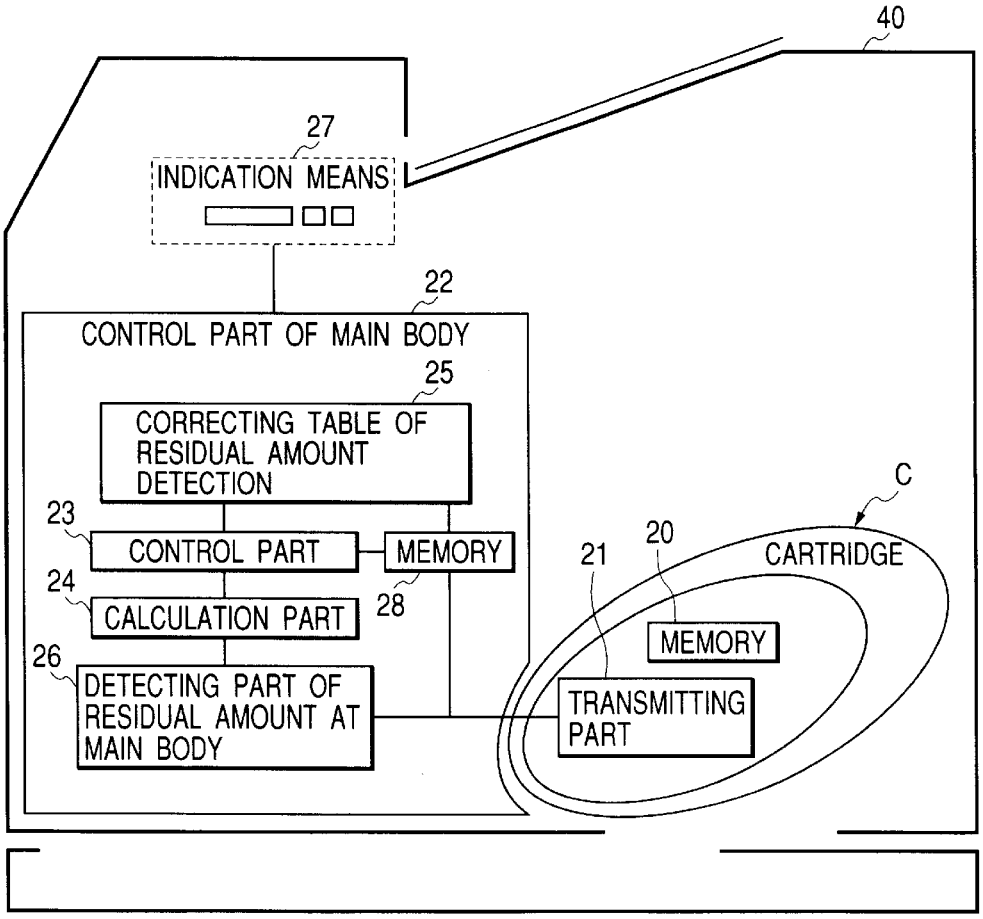
FIG. 5 is a block diagram for illustrating the access state of an apparatus main body and a cartridge according to the present invention.

A comparison detecting circuit 109 generates a voltage V3 from the difference between a reference value generated across a reference capacitor 105 (electrostatic capacitance C1: fixed value), that is, a voltage V1, and a measured value generated with respect to the synthetic capacitance of the electrostatic capacitance between the first metal plate 100 and the second metal plate 101 (C3: variable with residual toner amount) and the electrostatic capacitance between the developing roller 2 and the first metal plate 101 (C2: variable with residual toner amount), i.e., (C4=C2+C3), that is a voltage V2. This voltage V3 is input to a calculation part (AD conversion part) 24, where the analog voltage V3 is converted to a digital value (hereinafter this value will be referred to as "detection value" in the unit of (V)), and the result is transmitted to a control part 23, determining the residual toner amount level (referred to as "calculated value" in the unit of by using a correcting table of residual amount detection 25 (FIG. 5).

In this embodiment, a bias obtained by superimposing an AC bias of approximately 2 kHz which is a developing bias and a DC bias of approximately −400 V one upon the other is used as the application bias, measurement being conducted simultaneously with the development.

<Range Allowing Detection (Detectable Range)>

Figure 6:
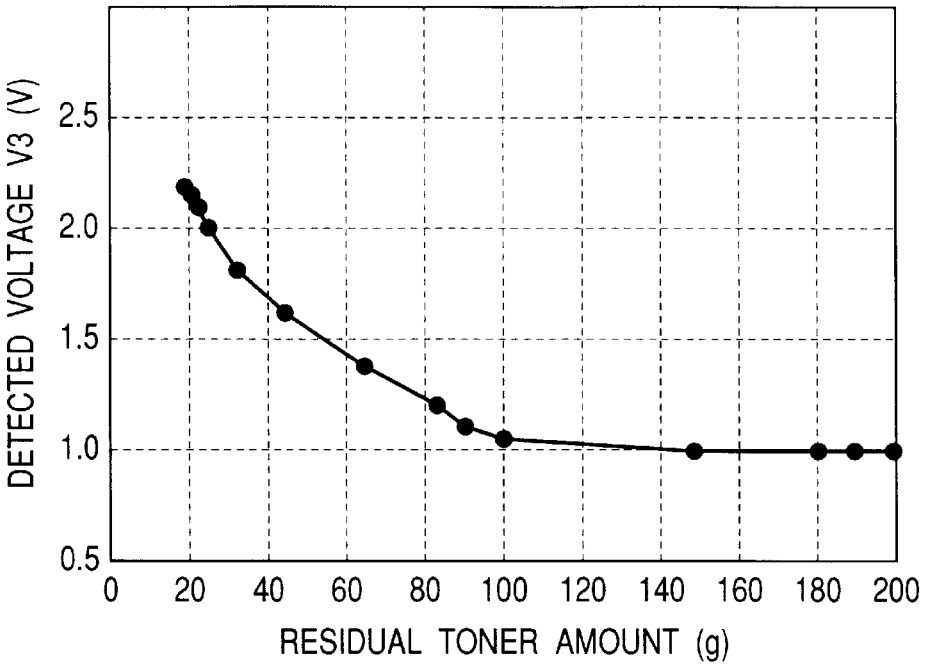
FIG. 6 is a graph showing the relationship between residual toner amount and detected voltage V3 in a residual developer amount detecting device according to the embodiment.

As stated above, in this embodiment, the developing roller 2 and the first metal plate 100 and the second metal plate 101 relatively close to the developing roller 2 are used as the residual developer amount detecting means, so that, due to the positional relationship of these components, the detected voltage (V3 in FIG. 4) starts to decrease, as shown in FIG. 6, when the toner in the developing apparatus 4 has been consumed to approximately half or less (100 g in this embodiment). Thereafter, the toner residual amount can be successively detected until a level is achieved where there is no sufficient amount of toner allowing development (approximately 20 g in this embodiment).

<Manufacturing Tolerance Correcting Method>

Figure 7:
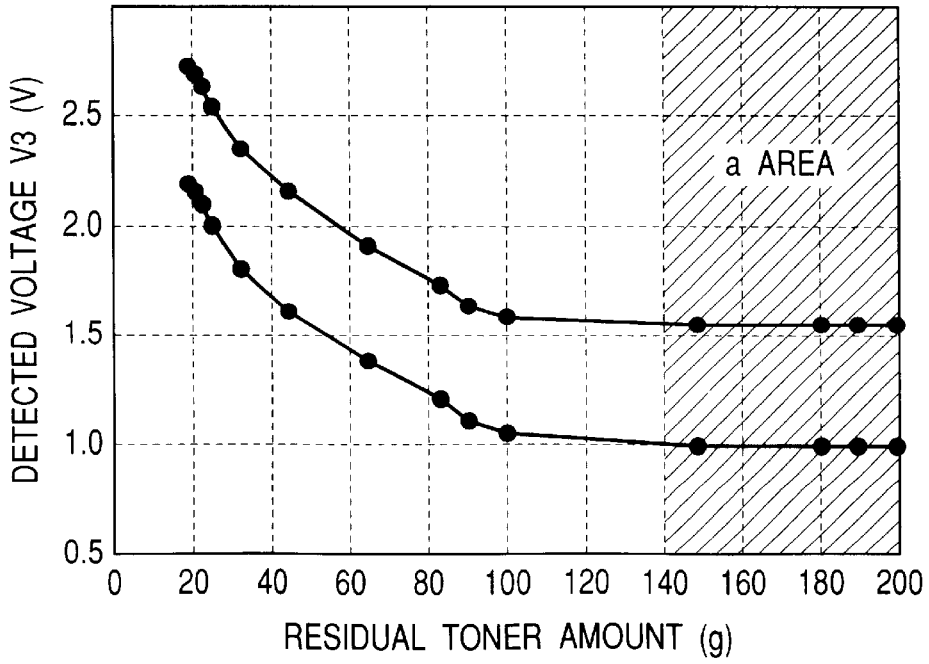
FIG. 7 is a graph showing the relationship between residual toner amount and detected voltage V3 in a residual developer amount detecting device according to the embodiment.

The image forming apparatus main body 40 and the cartridge C have manufacturing tolerances, so that even when the residual toner amount is the same, the detected voltage (V) varies as shown in FIG. 7. To correct this, the value of region a in FIG. 7 where there is substantially no change in detected voltage (This value will be referred to as the "correction value a") is stored, and used as a reference value in residual amount detection. Then, the residual amount detection is performed based on the change from the correction value a. By using this method, detection is possible with the same accuracy for either case shown in FIG. 7. In this embodiment, the correction value a is determined by a method using the smallest of the detected values in the past. More specifically, a sequence is adopted in which all the detected voltage values are compared with the correction value a of the storage means, the detected voltage value a serving as the new correction value a only when the current detected voltage value is smaller than the stored correction value a.

<Storage Means (Memory)>

Next, the storage means (memory) 20 mounted in the cartridge C will be described.

As shown in FIGS. 1, 3, and 5, the cartridge C of this embodiment has at the forward end of the waste toner container 9 a memory 20 and a cartridge side transmitting part 21 for controlling the reading and writing of information from and to the memory 20. When the cartridge C is attached to the apparatus main body 40, the cartridge side transmitting part 21 and the main body control part 22 are opposed to each other. Further, the main body control part 22 includes the function of a main body side transmitting means.

Further, the memory 20 is provided on the waste toner container 9 side. This is because the cartridge C is inserted into the apparatus main body 40 starting with the waste toner container 9, thus facilitating the positioning of the memory 20 and the communicating means on the apparatus main body 40 side.

There is no particular limitation regarding the memory 20 used in the present invention. It may be an ordinary semiconductor electronic memory, such as a non-volatile memory and a combination of a volatile memory and a back-up battery.

In particular, in the case of a non-contact memory which performs data communication between the memory and the read/write IC with electromagnetic waves, the transmitting part 21 and the main body control part 22 are in a non-contact relationship, so that there is no possibility of defective contact due to the attachment condition of the cartridge C, thus making it possible to perform control with high reliability. In this embodiment, a non-contact type memory (ex. RF) is used as the memory 20.

<Memory Control Construction>

With reference to FIG. 5, the memory control construction in this embodiment will be described.

On the cartridge C side, there are arranged the memory 20 and the transmitting part 21. Further, on the main body 40 side, there-is arranged a main body control part 22, which includes a control part 23, a calculation part 24, a correcting table of residual amount detection 25, a residual amount detecting part 26, a main body side memory 28, etc.

This main body control part 22 forms a control means for performing reading and writing of information of the cartridge side memory 20.

<Access of Cartridge Side Memory to Apparatus Main Body>

The information written to the cartridge side memory 20 is transmitted to the main body side memory 28 when the use of the cartridge C is started.

At the time of printing, the "residual toner amount value" is calculated by the above-described method, and the display is updated as needed. Further, these values are stored in the main body side memory 28 each time calculation is performed, and, when the display are changed or printing is stopped, they are transmitted to the cartridge side memory 20 and stored there.

It is understood that a plurality of cartridges are used in the main body side memory 28. Thus, when it is to be assumed that a cartridge has been replaced (e.g., when the power source of the apparatus main body 40 is turned on or when the door of the apparatus main body 40 through which the cartridge C is put in and taken out is closed), the contents of the main body side memory 28 are all reset.

<General Sequence>

The basic control flow in this embodiment will be described in detail with to the flowchart of FIG. 8. By for example, turning on the power source, the reference mage forming apparatus is put in the standby state (S101). The residual amount information in the cartridge memory 20 is transmitted to the apparatus main body 40, and the residual toner amount value is indicated on a main body indication means 27, and the apparatus is put in the printing standby state (S102). When printing is started, the residual toner amount is calculated (S103), and the calculated value is compared with the indicated value (S104).

It is checked whether the residual toner amount is less than the current indicated value (S105). When the answer is YES, the indicated value and the memory value of the apparatus main body 40 and the cartridge C are rewritten (S106) to complete the printing (S107). When the answer is NO, the printing is directly ended (S107).

After the completion of the printing, the procedure returns to step S103 to start printing.

<One Way Writing>

It is difficult to always perfectly detect the actual residual toner amount level with a low cost construction, and detection errors can be generated due to various reasons, such as longitudinal tilting of toner and measurement errors. As a result, it can happen that the detected value fluctuates even though the toner amount is completely the same or that the detected value increases while the actual toner amount has decreased.

In order that the user may not be confused in such cases, this embodiment adopts a "one way writing sequence" in which the indicated value and the memory value of the residual toner amount never increase but always decrease. That is, the minimum of the residual amount values calculated is always indicated and stored.

<Detection Timing>

Figure 8:
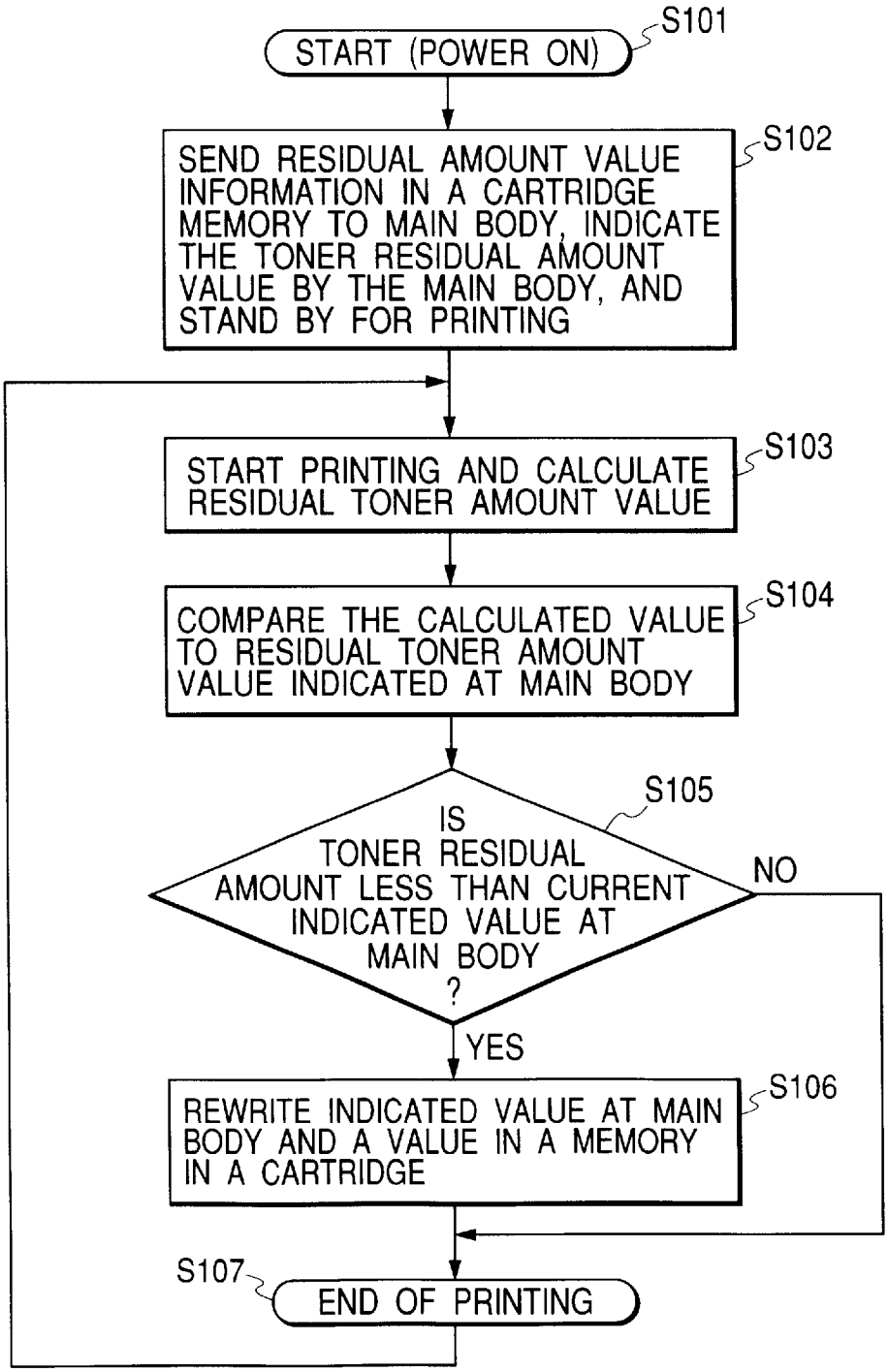
FIG. 8 is a flowchart illustrating the way control is performed according to an embodiment of the present invention.

Usually, as shown by the sequence of FIG. 8, the residual toner amount is calculated with all the timings with which the developing bias is applied, and the indication, etc. are rewritten when the residual amount decreases.

As stated above, this embodiment adopts a "one way writing sequence" so as not to confuse the user. However, if one calculated value is extremely small as compared with the actual residual toner amount, that value is also indicated and stored, resulting in a deterioration in accuracy.

Further, if a small detected voltage value is unexpectedly generated in the region a shown in FIG. 7, a value with low accuracy is stored as the correction value a, resulting in a general deterioration in detection accuracy.

<Toner Behavior during Long Rest Period>

The way force is applied to the toner in the state when the driving system is at rest is greatly different from that in the state in which the developing roller 2 and the agitating member 3 imparting conveying force to the toner are being driven. If the rest period is short, no serious problem is involved. When, however, the rest period is long, the toner distribution varies, and the measurement result can be different to a large degree.

The case of this embodiment will be described with reference to FIG. 1. During the rest period, no force is applied to the toner but the weight of the toner itself. When left to stand in this state for a long period of time, the density of the portion of the toner near the sleeve increases, and if residual toner amount detection is effected in this state, a value larger than the actual toner amount is indicated.

Even in such a state, if the toner in the cartridge is circulated for a period of time not shorter than a fixed period, the toner state is stabilized, and a substantially normal value is reached again. Thus, if it is determined that the apparatus has been at rest for a long period of time, it is desirable to stop the storing in the storage means for a predetermined period of time.

In the following, the sequence by means of which the above problem is coped with in this embodiment will be described with reference to the flowchart of FIG. 9.

By turning on the power source, etc., the image forming apparatus is started (S201), and the memory values related to the residual toner amount in the memory 20 of the cartridge C are transmitted to the apparatus main body, and the residual toner amount is indicated by the indication means 27 of the apparatus main body, and the apparatus is put in the printing standby state (S202).

After resetting the driving time value (S203), the continuation timer (i.e., the continuous rest period counter) is reset, and the integration of the continuation time is started (S204). Thereafter, the apparatus is put in the printing standby state or the procedure is ended (S204) and printing starts (S205).

When printing is started (S205), the integration of the continuation timer is finished, and the residual toner amount is calculated, and the counting of the driving time is started (S206). A judgment is made as to whether the continuation timer value is larger than a predetermined time value (S207).

When the continuation time is longer than the predetermined time, the driving time is reset (S213), and integration is newly started to complete the printing (S212). When the continuation time is shorter than the predetermined time, it is checked whether the integration value of the driving time is larger than a predetermined value or not (S208). If not, the printing is ended (S212). If it is larger than the predetermined value, the residual toner amount is calculated, and compared with the residual toner amount value as indicated on the main body (S209), and it is determined whether the residual toner amount value is smaller than the current indicated value (S210).

If the residual toner amount value is smaller than the current indicated value, the main body indicated value and the memory value are rewritten (S211), and then printing is terminated (S212). If the residual toner amount value is larger than the current indicated value, the printing is directly terminated (S212).

As described above, in the control of this embodiment, there is provided apart from the ordinary residual amount detection sequence, a residual amount detection sequence for a special case (at the time of a long continuation). Due to this arrangement, it is possible to use the apparatus without any substantial deterioration in detection accuracy.

While in this embodiment the predetermined value to be compared with the accumulation value of the driving time of the driving system of the image forming apparatus is 60 seconds, and the predetermined value of the continuation timer is 7 hours, these values have to be set to optimum levels according to the construction.

Further, while the driving time of the driving system of the image forming apparatus is used as the "predetermined interval" not stored in the storage means, it is not always necessary to use the driving time; the same effect can be obtained by using a predetermined number of printed sheets, etc.

Figure 9:
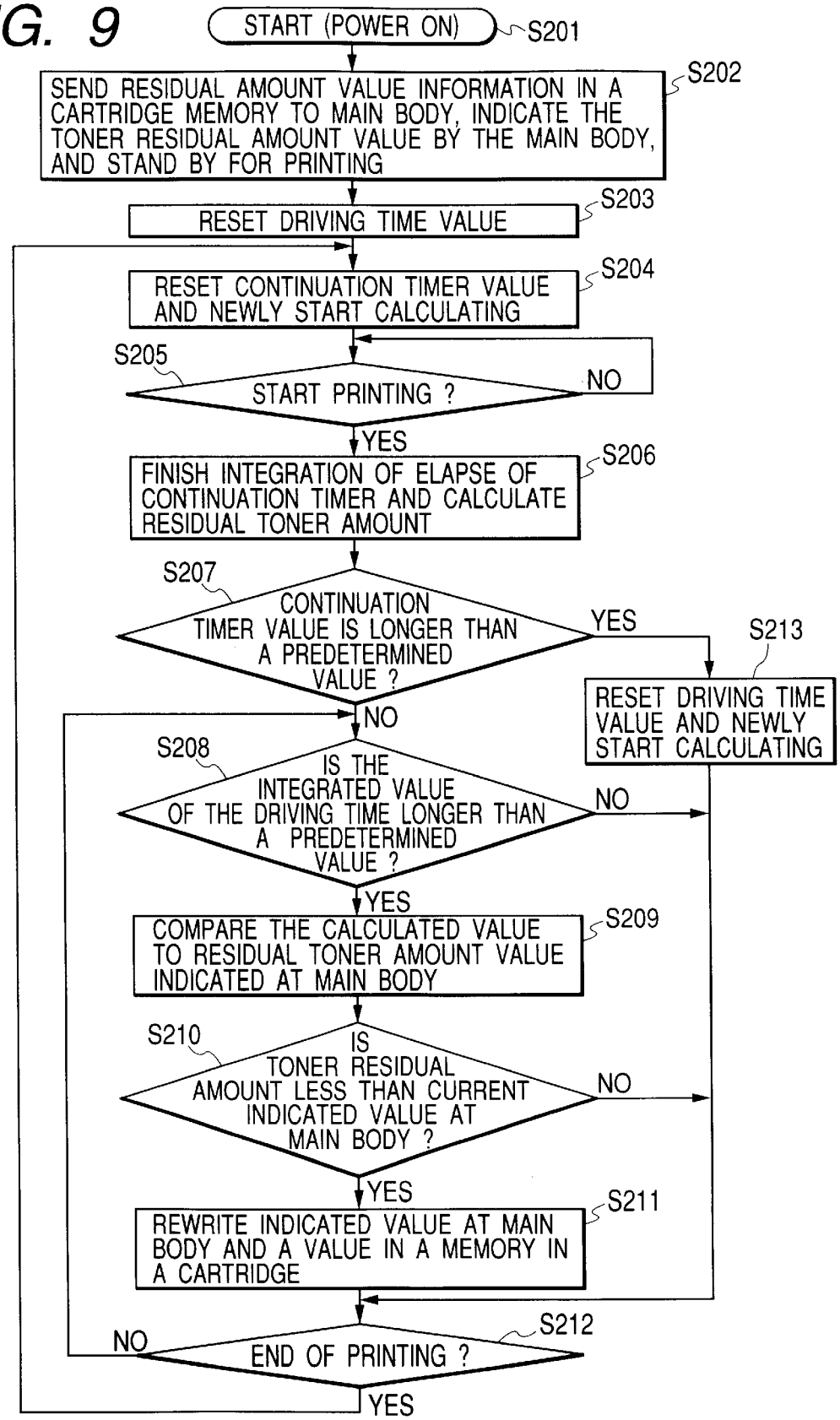
FIG. 9 is a flowchart illustrating the way control is performed according to another embodiment of the present invention.

The residual toner amount calculation in FIG. 9 consists of:

1: the portion determining the value of region a (correction value a) shown in FIG. 7; and 2: the portion calculating the residual amount (%) from the current detected value (Volt) by using the current correction value a. As can be understood from the sequence, this embodiment is characterized in that while residual toner amount calculation is conducted for a predetermined period of time when the continuation timer, i.e., the continuous rest period counter, has operated, the indication and the storage means are not updated.

Further, in the above sequence, while the driving time is being integrated, correct detection cannot be effected, so that in this embodiment the latest residual amount value stored in the memory is indicated. However, this method should not be construed restrictively. For example, it is also possible to perform indication only without storing the above calculated value, or roughly calculate the toner reduction value by using information, such as the laser emission time or number of printed sheets, and indicate the same, switching to the calculated value of this construction with high detection accuracy after a predetermined driving time has elapsed.

While in the above-described embodiment the correcting table of residual amount detection 25 is stored in the control part 22 of the main body, it may also be stored in the cartridge side memory 20. This will make it possible to use a table in conformity with the characteristics of each cartridge in a state in which it is held by the cartridge itself, making it possible to perform sequential residual developer amount detection more accurately in correspondence with various cartridges.

While in the above-described embodiment the reduction/increase of the electrostatic capacitance detected by the residual developer amount detecting means is reversed to that of the detected voltage of the detecting part of residual amount 26, this relationship varies depending upon the detecting circuit provided in the image forming apparatus; it is also possible for both the electrostatic capacitance and the voltage to decrease or increase.

Further, the notation of the residual toner amount is not restricted to (g) and (%). It is also possible to adopt some other notation. For example, as an advanced type of notation, it is possible to indicate the number of remaining sheets that can be output.

Further, there is no particular limitation regarding the manner of indication on a display as long as the user is enabled to know the residual toner amount. For example, it is possible to adopt a gas gauge, a bar graph, a value indication, or the indication of the remaining amount (%) with respect to the full state.

Figure 10:
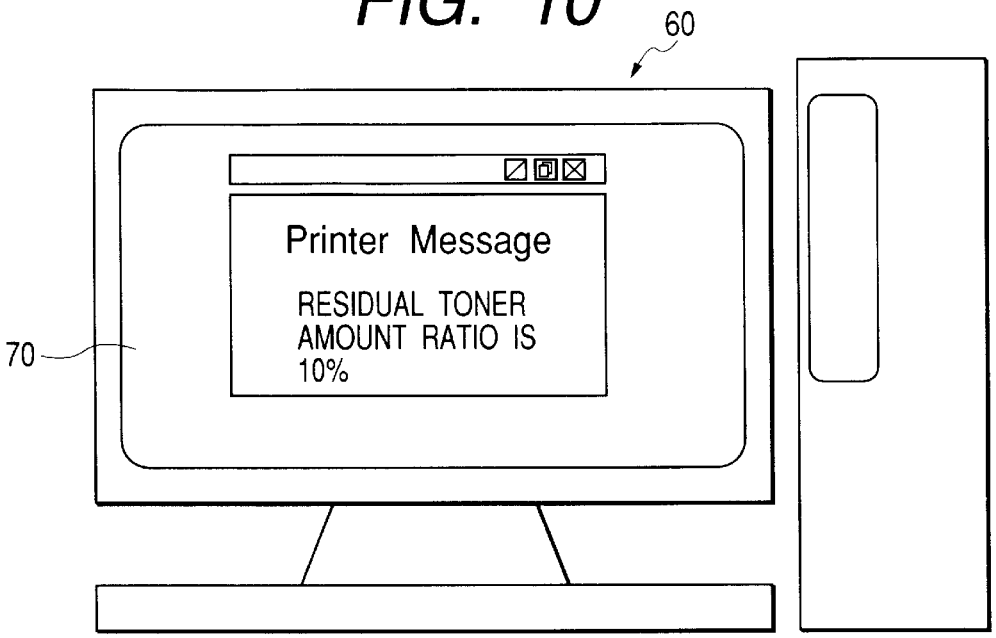
FIG. 10 is a schematic diagram showing how the residual toner amount is indicated according to an embodiment.

Further, the means of indicating the residual toner amount is not restricted to the indication means 27 provided in the image forming apparatus main body. As shown in FIG. 10, it is also possible to adopt an indication means such as a screen 70 of a host computer 60, etc., connected to the apparatus main body 40 so as to allow communication.

While this embodiment adopts a metal plate system as the residual toner amount level detecting means, this should not be construed restrictively. Any type of system will do as long as the residual toner amount level can be detected. Further, while the sequential residual amount detecting means is provided in the developing container, it is also possible to provide a plurality of detection means in order to achieve an improvement in accuracy. For example, it is possible to provide a residual amount detecting means in the toner container, performing sequential residual amount detection from the toner full state to the exhaustion of toner.

Further, instead of adopting the construction in which the residual toner amount is sequentially detected, it is possible to achieve the same effect by adopting the means of this embodiment in which "when it is determined that the apparatus has been at rest for a long period of time, the storing of information in the storage means is not conducted for a predetermined period".

While in the above-described embodiment the present invention is applied to an electrophotographic image forming apparatus to which a process cartridge is detachably mounted, it goes without saying that the present invention is also applicable to an electrophotographic image forming apparatus to which a developing apparatus in the form of a cartridge, i.e., a developing cartridge is detachably mounted. Next, the developing cartridge will be described.

Second Embodiment

Figure 11:
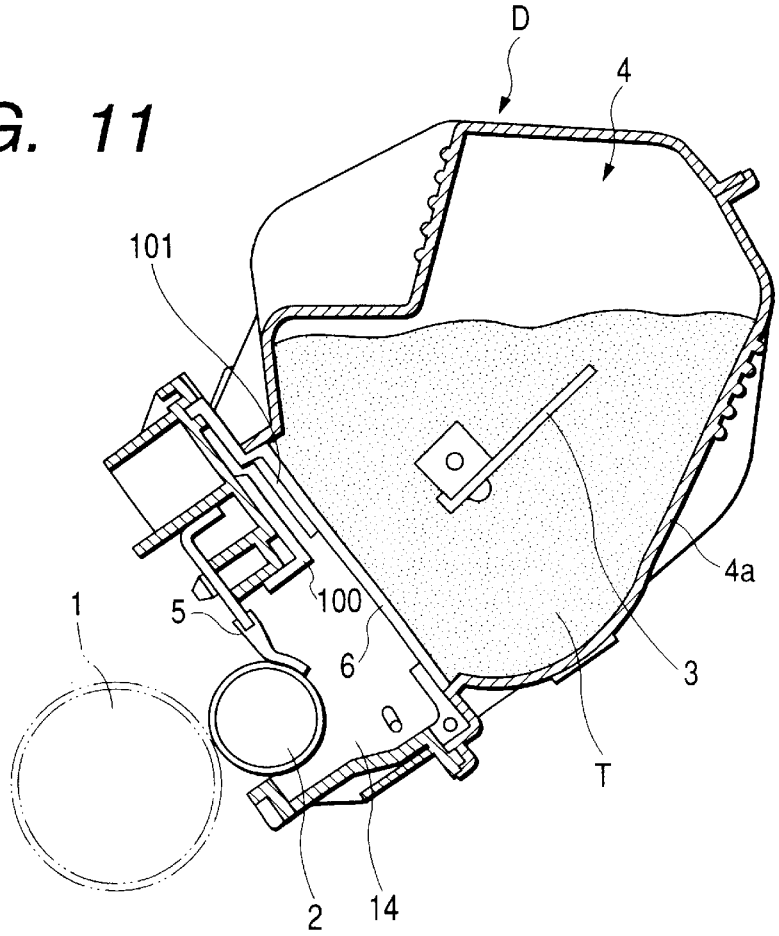
FIG. 11 is a diagram showing the construction of a developing cartridge according to an embodiment.

FIG. 11 shows a developing apparatus D in the form of a cartridge, which constitutes another embodiment of the present invention. In the developing apparatus D of this embodiment, a developing container 14 equipped with a developer bearing body (developing means) such as a developing roller 2 and a toner container 4*a* accommodating developer to be supplied to the developer bearing body are formed into an integral cartridge. That is, the developing apparatus D of this embodiment is obtained by forming the developing apparatus forming portion of the process cartridge C of Embodiment 1 as a unit. That is, it can be regarded as an integral cartridge which does not include the photosensitive drum 1, the charging means 2, and the cleaning means 7 of the process cartridge C.

Thus, the construction of the developing apparatus forming portion and that of the residual developer amount detecting device of Embodiment 1 are all applicable to the developing apparatus D of this embodiment. Thus, the above description of Embodiment 1 is applicable to the construction and operation of this embodiment.

With the construction of this embodiment also, the effect of Embodiment 1 can be achieved.

While the described embodiment represents the preferred form the present invention, it is to be understood that modifications will occur to those skilled in that art without departing from the spirit of the invention. The scope of the invention is therefore to be determined solely by the appended claims.

What is claimed is:

1. An image forming apparatus for forming an image on a recording medium to which a cartridge having a developer containing portion and storage means for storing latest residual developer amount information is detachably attachable, wherein said image forming apparatus comprises:

a continuous rest time counter which is configured to count a continuous rest time of said image forming apparatus; and a controller which is configured to prohibit updating of the residual developer amount information stored in the storage means for a predetermined period after the end of the continuous rest time of said image forming apparatus when said continuous rest time counter indicates a time equal to or more than a predetermined time.

2. An image forming apparatus according to claim 1, wherein the predetermined period is a predetermined driving time of a driving system of said image forming apparatus.

3. An image forming apparatus according to claim 1, wherein the predetermined period is a period corresponding to a requisite time for printing on a predetermined number of recording media.

4. An image forming apparatus according to claim 1, wherein said controller generates the residual developer amount information on the basis of a signal obtained by measuring an electrostatic capacitance between at least two electrodes.

5. An image forming apparatus according to claim 1, further comprising indication means, wherein a signal for indicating information on a detected residual developer amount is transmitted to said indication means for display.

6. An image forming apparatus according to claim 1, wherein said image forming apparatus is further capable of communicating with an apparatus having indication means, and wherein a signal for indicating information on a detected residual developer amount is transmitted to the apparatus having the indication means for display.

7. An image forming apparatus according to claim 1, wherein the cartridge further includes at least one of an electrophotographic photosensitive body, charging means for charging the electrophotographic photosensitive body, developing means for supplying a developer to the electrophotographic photosensitive body, and cleaning means for cleaning the electrophotographic photosensitive body.

8. An image forming system for forming an image on a recording medium by using a cartridge detachably attachable to an image forming apparatus, said image forming system comprising:

(a) a cartridge having: a developing apparatus equipped with a developer containing portion containing a developer; a residual developer amount detecting means for detecting a residual developer amount in said developer containing portion; and storage means for storing latest residual developer amount information; and (b) an image forming apparatus main body equipped with a continuous rest time counter configured to count a continuous rest time of a driving system of the image forming apparatus, and control means for prohibiting updating of the residual developer amount information stored in said storage means for a predetermined interval when said continuous rest time counter indicates a time not shorter than a predetermined time.

9. An image forming system according to claim 8, wherein the predetermined interval is a predetermined driving time of the driving system of the image forming apparatus.

10. An image forming system according to claim 8, wherein the predetermined interval corresponds to a requisite time for printing a predetermined number of printed sheets.

11. An image forming system according to claim 8, wherein said residual developer amount detecting means outputs a signal obtained by measuring an electrostatic capacitance between at least two electrodes.

12. An image forming system according to claim 8, further comprising indication means, wherein a signal for indicating information on a detected residual developer amount is transmitted to said indication means for display.

13. An image forming system according to claim 8, wherein said image forming system is further capable of communicating with an apparatus having indication means, and wherein a signal for indicating information on a detected residual developer amount is transmitted to the apparatus having the indication means for display.

14. An image forming system according to claim 8, wherein said cartridge further includes at least one of an electrophotographic photosensitive body, a charging means for charging said electrophotographic photosensitive body, and cleaning means for cleaning said electrophotographic photosensitive body.

15. An image forming apparatus including a developing apparatus equipped with a developer containing portion containing a developer, a residual developer amount detector configured to detect a residual developer amount in the developer containing portion, and storage means for storing information, wherein said image forming apparatus comprises:

a time measuring unit which is configured to measure a non-operating time of the developing apparatus; and a controller which is configured to write residual developer amount information in the storage means on the basis of an output of the residual developer amount detector during an operating time of the developing apparatus, wherein said controller controls a predetermined period during which is said controller does not write in the storage means residual developer amount information based on an output of the residual developer amount detector after the non-operating time of the developing apparatus on the basis of the non-operating time measured by said time measuring unit.

16. An image forming apparatus according to claim 15, wherein said controller controls whether said controller does not write in said storage means residual developer amount information during the predetermined period or the length of the predetermined period according to the non-operating time measured by said time measuring unit.

17. An image forming apparatus according to claim 15, wherein the predetermined period is a period corresponding to a requisite time for printing on a predetermined number of recording media.

18. An image forming apparatus according to claim 15, wherein said residual developer amount detector outputs a signal obtained by measuring an electrostatic capacitance between at least two electrodes.

19. An image forming apparatus according to claim 15, wherein said image forming apparatus is further capable of communicating with indication means or an apparatus having indication means, and wherein a signal for indicating information on a detected residual developer amount is transmitted to the indication means or the apparatus having the indication means for display.

20. An image forming apparatus according to claim 15, wherein the developing apparatus, the residual developer amount detector, and the storage means are provided in a detachably attachable cartridge, and wherein the cartridge includes at least one of an electrophotographic photosensitive body, a charging means for charging the electrophotographic photosensitive body, and cleaning means for cleaning the electrophotographic photosensitive body.

* * * * *

UNITED STATES PATENT AND TRADEMARK OFFICE

CERTIFICATE OF CORRECTION

PATENT NO. : 6,661,980 B2 
DATED : December 9, 2003
INVENTOR(S) : Hideki Matsumoto et al.

It is certified that error appears in the above-identified patent and that said Letters Patent is hereby corrected as shown below:

Column 2,
Line 49, “to” should read -- is to --.

Column 6,
Line 25, “unit of” should read -- unit of (%)) --.
Line 51, “(This” should read -- (this --.

Column 7,
Line 52, “are” should read -- is --.
Line 64, “with” should read -- with reference --.
Line 65, “reference mage” should read -- image --.

Column 11,
Line 26, “the” should read -- of the --.

Column 13,
Line 5, “is” should be deleted.

Signed and Sealed this

Twenty-ninth Day of June, 2004

JON W. DUDAS
*Acting Director of the United States Patent and Trademark Office*